US005375922A

United States Patent [19]

Brüstle et al.

[11] Patent Number: 5,375,922

[45] Date of Patent: Dec. 27, 1994

[54] DRAWER PULL-OUT GUIDE FITTING WITH IMPROVED HEIGHT ADJUSTING CAM

[75] Inventors: Klaus Brüstle, Höchst; Emanuel Netzer, Langen, both of Austria

[73] Assignee: Julius Blum Gesellschaft m.b.H., Höchst, Austria

[21] Appl. No.: 986,545

[22] Filed: Dec. 7, 1992

[30] Foreign Application Priority Data

Dec. 6, 1991 [AT] Austria ..... 2426/91

[51] Int. Cl.[5] ..... A47B 88/00

[52] U.S. Cl. ..... 312/334.4; 312/330.1

[58] Field of Search ..... 312/334.4, 334.5, 334.3, 312/334.39, 334.42, 334.33, 330.1; 389/19, 18, 22

[56] References Cited

U.S. PATENT DOCUMENTS

| | | | |
|---|---|---|---|
| 2,523,821 | 9/1950 | Fox | 312/334.4 |
| 2,739,864 | 3/1956 | Saunders | 312/334.4 |
| 2,928,696 | 3/1960 | Hiers | 312/334.4 |
| 4,291,929 | 9/1981 | Faust | 312/334.4 |

FOREIGN PATENT DOCUMENTS

| | | | |
|---|---|---|---|
| 384535 | 11/1987 | Austria . | |
| 2656485 | 6/1978 | Germany | 312/334.4 |
| 8228143 | 1/1983 | Germany . | |
| 8903741 | 6/1989 | Germany . | |

*Primary Examiner*—Flemming Saether

*Attorney, Agent, or Firm*—Wenderoth, Lind & Ponack

[57] ABSTRACT

A pull-out guide fitting for a drawer, having two drawer frames (2) to which a respective pull-out rail (6) of the two pull-out rails (6) and a drawer guide fitting comprising two carcass-side support rails (5) is detachably secured. Each pull-out rail (6) has in the region of its rear end a hook by means of which it can be suspended in the drawer. There are provided, projecting transversely with respect to the pull-out direction of the pull-out rails (6), latching parts (9) which fix the pull-out rail (6) to the drawer frame (2) in the direction of displacement of the drawer guide fitting. There is assembled on the pull-out rails (6) a cam body (1) which is rotatable about a horizontal axis and on which the drawer bears. The cam body (1) is mounted in a cutout (4) in the upper horizontal web (6') and the drawer base (3) bears on the cam body (1).

20 Claims, 3 Drawing Sheets

DRAWER PULL-OUT GUIDE FITTING WITH IMPROVED HEIGHT ADJUSTING CAM

Figure 1:
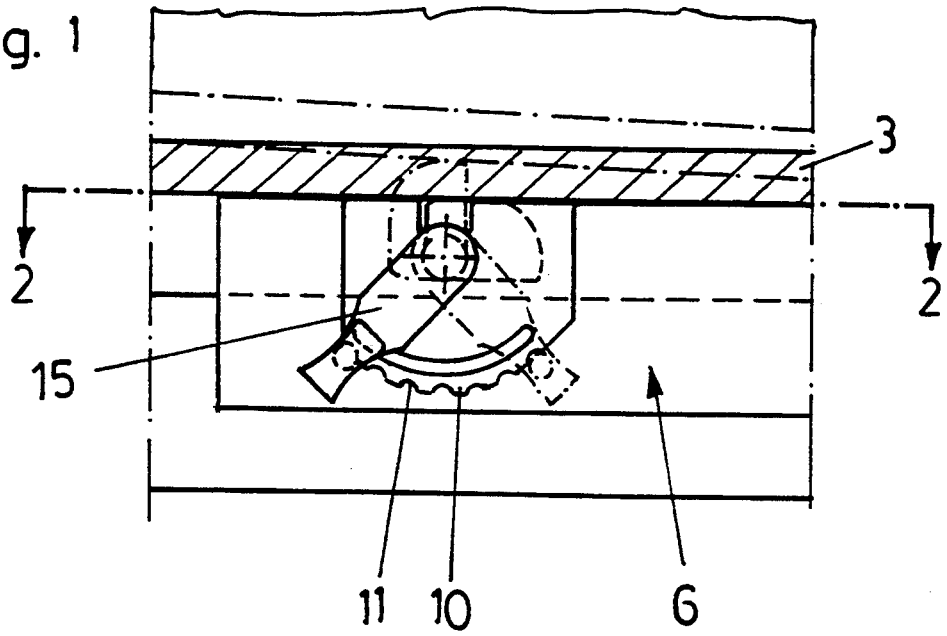

The invention relates to a pull-out guide fitting for a drawer having two drawer frames to each of which one pull-out rail of the two pull-out rails and a pull-out guide fitting comprising two carcass-side support rails is detachably secured, each pull-out rail having at its rear end a hook or the like by means of which it can be suspended in the drawer, and there being provided latching parts which project or are movable transversely with respect to the pull-out direction of the pull-out rails and which fix the pull-out rail to the drawer frame in the direction of displacement of the pull-out guide fitting, there being mounted on the pull-out rails, which have a lower and an upper horizontal web, a cam body which is rotatable about a horizontal axis and on which the drawer bears.

The invention relates in particular to drawers having drawer guide fittings in which the pull-out rails and the support rails are not separable. Generally, the roller parts are mounted in carriages in the case of such drawer guide fittings.

According to the prior art, two types of drawer guide fittings are known in which the rollers are not directly secured to one of the rails but are located in a separate carriage. The most well-known of these are the so-called ball castor drawers, the transmission of load between the rails being effected by means of steel balls which are held in a carriage constructed as a ball cage.

The other type of pull-out guide fittings has only recently come onto the market and has cylindrical rollers, of the same type as are normally directly mounted on the rails. These rollers, like the balls, are held in a carriage. The carriage itself does not transmit any forces.

Drawers and pull-out guide fittings have become known, in which it is possible to mount the pull-out guide fitting completely, i.e. with the pull-out rail or rails, in the furniture carcass and subsequently to suspend the drawer.

These embodiments also make it possible to remove the drawer simply, for example in order to clean it.

Examples of this are disclosed in AT-PS 384 535 and DE-GM 89 03 741.

DE-GM 82 28 143 discloses a pull-out guide fitting having a height adjustment means. Here, the drawer side walls have to have holes, which necessitates an additional operation. If the drawer is used with a pull-out guide fitting having no height-adjusting device, the holes have a disruptive effect.

The object of the invention is to make it possible to adjust the width of the horizontal joins in such drawers without the drawer side walls having to be altered.

The object according to the invention is achieved in that the cam body is mounted in a cutout in the upper horizontal web and the drawer base bears on the cam body.

The pull-out guide according to the invention makes it easy to adjust the height of the drawer in order either to straighten it or to compensate the joins between the drawers arranged one on top of the other in the furniture carcass. Here, the height-adjusting device is restricted in its construction to the pull-out guide.

Advantageously, it is provided that the pull-out rails have a lower and an upper horizontal web, and in that the cam body is mounted in a cutout of the upper horizontal web. As a result, the cam body can be rotated completely below the horizontal web, so that the drawer, should no height adjustment be necessary, bears snugly against the horizontal web of the pull-out rail.

A further embodiment of the invention provides for the cam body to be provided with a handle part having latching pegs, which handle part is guided along an arcuate toothed rack-like latching strip. In this manner, the height adjustment of the drawer can be effected without using a tool. The peg and the toothed rack-like latching strip make it possible to securely lock the cam body in any desired position.

An example embodiment of the invention will be described below with reference to the attached drawings.

Figure 2:
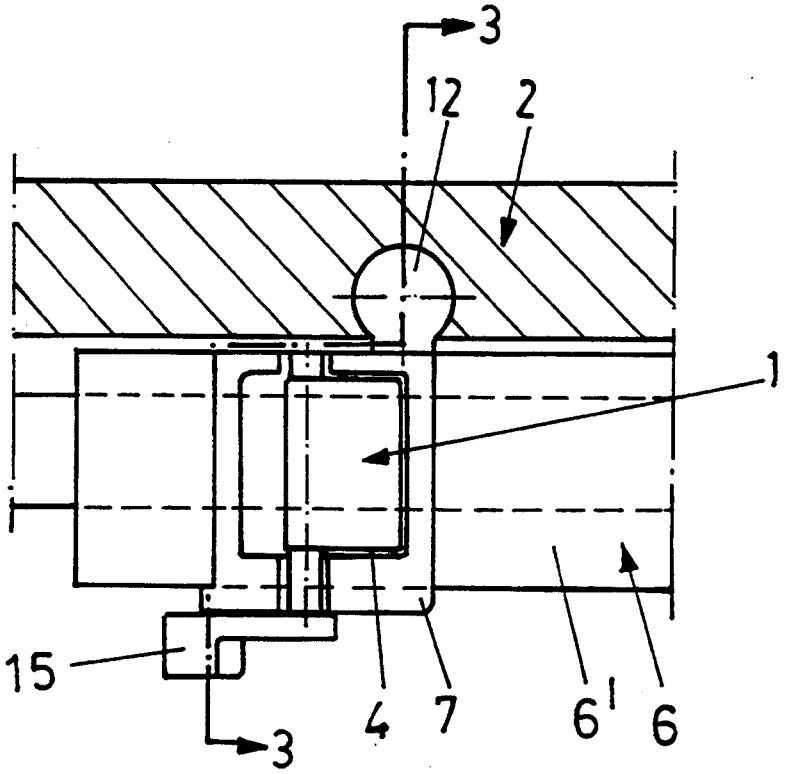
Figure 3:
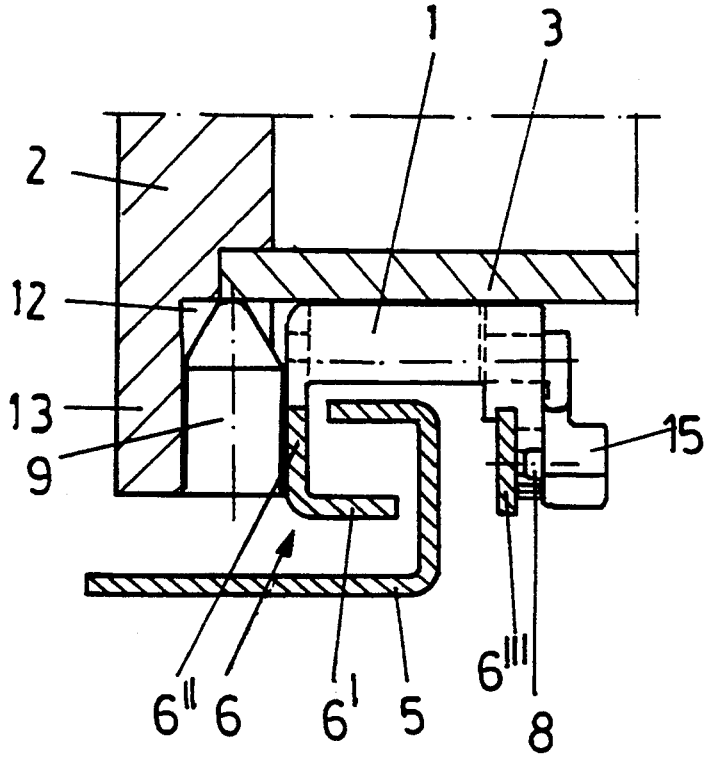
Figure 4:
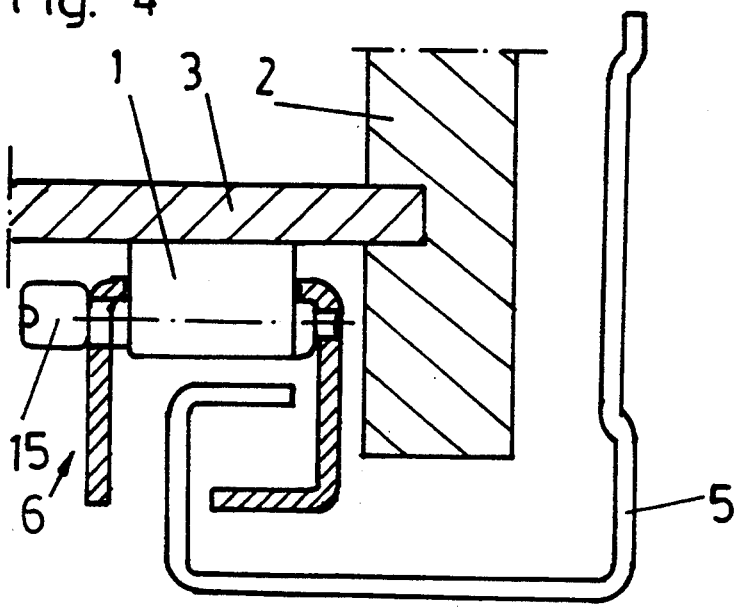
Figure 5:
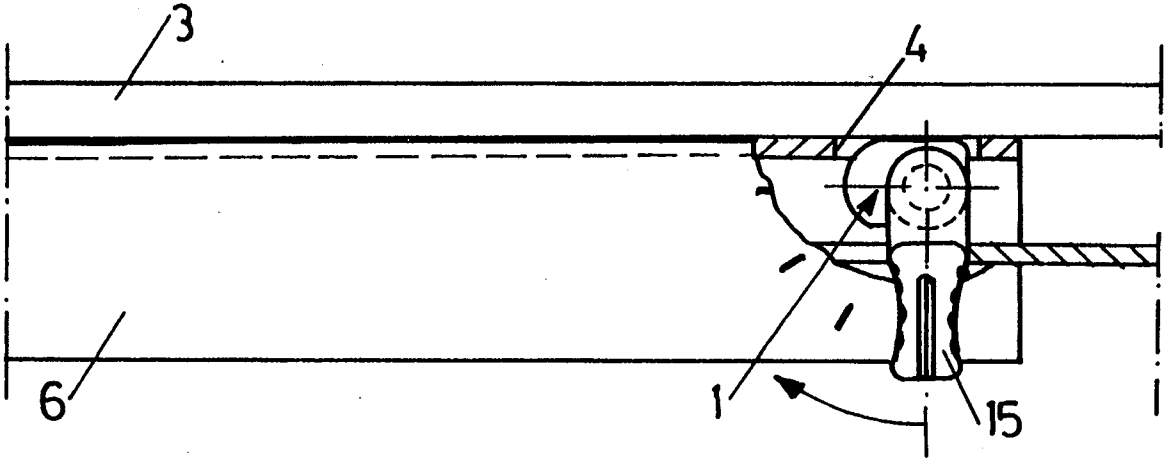
Figure 6:
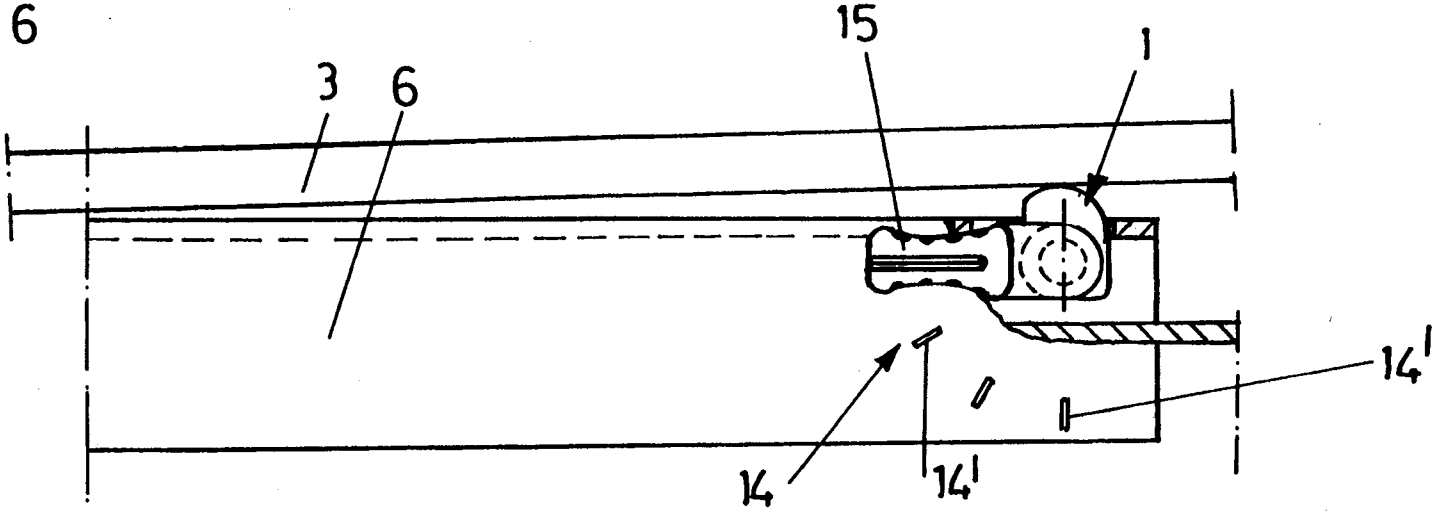

FIG. 1 shows a longitudinal section through the drawer in the region of the cam body, FIG. 2 shows a section along the line N—N of FIG. 1, FIG. 3 shows a section along the line O-R of FIG. 2, FIG. 4 shows a similar section to that in FIG. 3 in the case of a further example embodiment of the invention, and FIGS. 5 and 6 respectively show a portion of the drawer and of the pull-out rail according to this example embodiment.

The drawer according to the invention comprises, in conventional manner, the two drawer frames 2, a drawer rear wall, the drawer base 3 and a front panel.

The drawer frames 2 are advantageously produced from a wood material, for example chipboard, but can also be produced from plastics. Each drawer frame 2 has a portion 13 which projects downwards beyond the drawer base 3 of the drawer.

Each pull-out rail 6 has an upper and lower horizontal web 6', a continuous vertical web 6'' on one side which connects the two horizontal webs 6', and a marginal web 6''' on the other side.

At the back, each pull-out rail 6 is provided with a hook which on assembly engages directly in an opening in the drawer rear wall or in the drawer frame 2.

Each pull-out rail 6 is located exactly in the corner between the drawer base 3 and the drawer frame 2, in particular below the drawer base 3. A cutout 12 is located on the inside of the drawer. A latching part 9 which is mounted on each pull-out rail 6 is located at the same height (in the case of a drawer assembled on the pull-out rails 6). The latching part 9 in the example embodiment is welded to the pull-out rail 6, but can also be mounted movably thereon.

The cutout 12 is open to the bottom. In order to anchor the drawer the latter is placed onto the pull-out rails 6 and pushed back.

In the example embodiment, the cam body 1 is mounted next to the cutout 12 and the latching part 9 in the pull-out rail 6. The cam body 1 is located in a cutout 4 in the upper horizontal web 6' of the pull-out rail 6 and extends approximately over the entire width of the pull-out rail 6.

The drawer bears by means of the drawer base 3 directly on the cam body 1. In its lowermost position, the cam body 1 ends flush with the upper horizontal web 6' of the pull-out rail 6.

The cam body 1 is rotatable by way of a handle part 15. The handle part 15 is located in the region of the vertical web 6''' of the pull-out rail 6. The cam body 1 is mounted in a type of frame 7 which is placed onto the pull-out rail 6.

A latching peg 8 is located on the handle part 15, and the frame is provided with an arcuate toothed rack-like latching strip 10, so that the cam body 1 can be adjusted in steps and is held in any position in which the latching peg 8 latches in a notch 11 of the latching strip 10.

A cam body 1 is advantageously provided on each side of the drawer.

In the example embodiment according to FIGS. 5 and 6, there is provided instead of the toothed rack-like latching strip 10 in FIG. 1 in the marginal web 6''' of the pull-out rail 6 an arcuate row 14 of holes which is formed by slot-shaped holes 14'. A projection of the handle part 15, when the handle part 15 is rotated, latches in steps in these slot-shaped holes 14'. Conversely, instead of the slot-shaped holes 14' studs which in turn latch in a corresponding cutout in the handle part 15 could of course also be provided in the marginal web 6''' . The row 14 of holes and the projection on the handle part 15 enable the cam body 1 in turn to be locked in different intermediate positions.

FIG. 5 shows the cam body 1 and the drawer base 3 in the lowermost position, which is also termed the so-called factory setting. The pull-out guide fitting is supplied with the cam body 1 in this position and is assembled on the carcass side wall 2, after which the drawer is placed onto the pull-out guide fittings.

FIG. 6 shows the cam body 1 in the position of maximum height compensation. The same position of the cam body 1 is shown in FIG. 4.

In the figures of the drawing, the carcass-side support rail is designated 5. The carriage or rollers or sliders which are arranged between the pull-out rail 6 and the support rail 5 are not indicated.

We claim:

1. In a pull-out guide fitting for use on each of opposite sides of a drawer for guiding sliding movement thereof into and out of a furniture body, said fitting including a pull-out rail and a support rail detachably assembled as a unit to be mountable on the furniture body whereafter the drawer is removably mountable onto said pull-out rail, and a height adjusting device to selectively adjust the vertical position of the drawer relative to said pull-out rail when the drawer is mounted on said pull-out rail, the improvement wherein said height adjusting device comprises:

said pull-out rail including an upper horizontal web and two vertical webs, said upper horizontal web having formed therein a cutout located between said two vertical webs; and a cam body mounted for rotation about a horizontal axis within said cutout and between said two vertical webs at a position such that, when the drawer is mounted onto said pull-out rail, a base of the drawer will bear on said cam body, said cam body including a handle positioned adjacent to one of said vertical webs on a side thereof opposite said cam body, whereby manipulation of said handle to rotate said cam body about said axis will cause relative vertical displacement of the drawer relative to said pull-out rail.

2. The improvement claimed in claim 1, wherein said pull-out rail has an arcuate arrangement of first latching means, and said cam body has a second latching means, such that upon rotation of said cam body said second latching means is engageable with a selected said first latching means to thereby retain said cam body in a respective relative position of rotation.

3. The improvement claimed in claim 2, wherein said arcuate arrangement of first latching means comprises an arcuate row of openings formed in a vertical web of said pull-out rail.

4. The improvement claimed in claim 3, wherein said second latching means comprises a projection extending laterally from said handle and fittable into a selected said opening.

5. The improvement claimed in claim 2, wherein said arcuate arrangement of first latching means comprises a row of notches formed in an edge of an arcuate member.

6. The improvement claimed in claim 5, wherein said second latching means comprises a peg extending from said handle and fittable into a selected said notch.

7. The improvement claimed in claim 5, wherein said cam body is rotatably mounted in a frame member that is mounted on said pull-out rail and that defines said cutout, and said arcuate member is part of said frame member.

8. The improvement claimed in claim 1, wherein said cam body extends approximately over a width dimension of said upper horizontal web.

9. The improvement claimed in claim 1, wherein said cam body has a cam surface that, upon rotation of said cam body, is elevatable above an upper surface of said upper horizontal web to thereby lift the drawer relative to said pull-out rail, and that is flush with said upper surface at a lowermost position of the drawer relative to said pull-out rail.

10. The improvement claimed in claim 1, wherein said pull-out rail has extending laterally therefrom a member operable to fix said pull-out rail to the drawer relative to a direction of sliding movement thereof.

11. In an arrangement on each of opposite sides of a drawer for guiding sliding movement thereof into and out of a furniture body, said arrangement including a fitting including a pull-out rail and a support rail detachably assembled as a unit to be mountable on the furniture body whereafter said drawer is removably mountable onto said pull-out rail, and a height adjusting device to selectively adjust the vertical position of said drawer relative to said pull-out rail when said drawer is mounted on said pull-out rail, the improvement comprising:

said pull-out rail including an upper horizontal web and two vertical webs, said upper horizontal web having formed therein a cutout located between said two vertical webs; and a cam body mounted for rotation about a horizontal axis within said cutout and between said two vertical webs at a position such that a base of said drawer bears on said cam body, said cam body including a handle positioned adjacent to one of said vertical webs on a side thereof opposite said cam body, whereby manipulation of said handle to rotate said cam body about said axis causes relative vertical displacement of said drawer relative to said pull-out rail.

12. The improvement claimed in claim 11, wherein said pull-out rail has an arcuate arrangement of first latching means, and said cam body has a second latching means, such that upon rotation of said cam body said second latching means is engageable with a selected said first latching means to thereby retain said cam body in a respective relative position of rotation.

13. The improvement claimed in claim 12, wherein said arcuate arrangement of first latching means comprises an arcuate row of openings formed in a vertical web of said pull-out rail.

14. The improvement claimed in claim 13, wherein and said second latching means comprises a projection extending laterally from said handle and fittable into a selected said opening.

15. The improvement claimed in claim 12, wherein said arcuate arrangement of first latching means comprises a row of notches formed in an edge of an arcuate member.

16. The improvement claimed in claim 15, wherein said second latching means comprises a peg extending from said handle and fittable into a selected said notch.

17. The improvement claimed in claim 15, wherein said cam body is rotatably mounted in a frame member that is mounted on said pull-out rail and that defines said cutout, and said arcuate member is part of said frame member.

18. The improvement claimed in claim 11, wherein said cam body extends approximately over a width dimension of said upper horizontal web.

19. The improvement claimed in claim 11, wherein said cam body has a cam surface that, upon rotation of said cam body, is elevatable above an upper surface of said upper horizontal web to thereby lift said drawer relative to said pull-out rail, and that is flush with said upper surface at a lowermost position of said drawer relative to said pull-out rail.

20. The improvement claimed in claim 11, wherein said pull-out rail has extending laterally therefrom a member fixing said pull-out rail to a side wall of said drawer relative to a direction of sliding movement thereof.

* * * * *